United States Patent [19]

Ingersoll

[11] Patent Number: 4,693,632

[45] Date of Patent: Sep. 15, 1987

[54] SYSTEM AND METHOD FOR CONTROLLING EROSION OF A SHORELINE

[75] Inventor: Roger W. Ingersoll, Carrollton, Tex.

[73] Assignee: Mobil Oil Corporation, New York, N.Y.

[21] Appl. No.: 856,566

[22] Filed: Apr. 28, 1986

[51] Int. Cl.[4] ..... E02B 3/12

[52] U.S. Cl. ..... 405/18; 405/17; 405/258

[58] Field of Search ..... 405/15, 16, 17, 18, 405/19, 20, 258

[56] References Cited

U.S. PATENT DOCUMENTS

| | | | |
|---|---|---|---|
| 2,570,271 | 10/1951 | Pickett | 405/19 X |
| 4,102,137 | 7/1978 | Porraz et al. | 405/18 |
| 4,135,843 | 1/1979 | Umemoto et al. | 405/19 X |
| 4,405,257 | 9/1983 | Nielson | 405/19 |
| 4,420,275 | 12/1983 | Ruser | 405/18 X |
| 4,449,847 | 5/1984 | Scales et al. | 405/19 |
| 4,486,121 | 12/1984 | Thompson et al. | 405/18 X |

OTHER PUBLICATIONS

"Constructing Artificial Islands in Canada's Beaufort Sea", Ocean Industry, Jun. 1982, pp. 28–31.

"New Concepts in Erosion Control", Ocean Industry, Jul. 1982, pp. 88–89.

"Articial Islands", Civil Engineering ASME, Aug. 1983, pp. 38–41.

"First Exploration Islands Built in Gulf", Cohesion, vol. 18, No. 3, 7/82, p. 12 et sec.

*Primary Examiner*—Richard J. Scanlan, Jr.

*Assistant Examiner*—Kristina Hall

*Attorney, Agent, or Firm*—Alexander J. McKillop; Michael G. Gilman; Charles J. Speciale

[57] ABSTRACT

A system for controlling erosion of a slope below the waterline of a shoreline and a method for installing the system wherein a plurality of armorbags are assembled, filled with grouting material, and lowered and accurately positioned as a unit onto the slope.

2 Claims, 4 Drawing Figures

SYSTEM AND METHOD FOR CONTROLLING EROSION OF A SHORELINE

DESCRIPTION

1. Technical Field

The present invention relates to shoreline erosion control and more particularly relates to a system and method for accurately installing a plurality of individual armor bags on the slope of a shoreline below the waterline for controlling erosion thereof.

2. Background Art

Artificial islands are now being used in certain offshore areas, e.g. Artic, to serve as (1) drilling platforms during the search for hydrocarbons and (2) production facilities once sufficient reserves are discovered. As understood in the art, an "artificial" island is a man-made island which is constructed by dumping fill material, e.g. gravel or the like, on the marine bottom until the surface of the island extends above the waterline. For a discussion of known techniques for constructing artificial islands, see "Artificial Islands", Civil Engineering ASCE, August 1983, pp 38–41.

Unfortunately, normal wave action will quickly erode the shoreline of an artificial island, and, unless protected from this erosion, the island will shortly be reclaimed by the sea. Several techniques are known for protecting these islands from erosion to thereby substantially extend their operational lives. One such technique is to build an island which has a large, gradually-sloping sacrificial beach but, as will be recognized, this is extremely expensive, especially in those areas where the required amounts of fill material are not readily available.

Another widely-used erosion control techniques involves the placement of armor bags (e.g. sandbags) on the slope around the perimeter of the island at and below the waterline. While this technique provides good erosion control, the actual placement of the sandbags in the required pattern below the waterline is difficult to achieve. Further, while known sandbagging techniques protect the island during initial operation, extended periods of wind, wave and ice conditions will in time prove too great for routine sandbagging and eventually serious erosion is likely. This is important where an island is originally built as a drilling island but is later converted to a production island. Known sandbagging techniques can be used to protect the island during drilling operations but this type of erosion control must be supplimented with additional means to protect the island during the extended operations.

DISCLOSURE OF THE INVENTION

The present invention provides a system for controlling erosion of a slope below the waterline of a shoreline and a method for installing the system wherein a plurality of armor bags are assembled, filled with grouting material, and lowered and accurately positioned as a unit onto the slope.

More specifically, the system is comprised of an elongated conduit having a plurality of armor bags attached thereto. The conduit is pivotably secured to the shoreline approximately at the waterline. At least one grout line is connected to the conduit and all of the bags are filled with grout through inlets which fluidly communicate the respective bags with the conduit. A cable is connected to the conduit and passes down through an eyelet means which is positioned on the marine bottom and back to a winch means on the water surface. When the bags are filled with grout, the system is positively pulled by the cable downward to accurately position the bags as a unit on the slope.

In another embodiment, elongated supports are connected to the elongated conduit by cross supports to form individual support frames which, in turn, have individual armor bags secured therein. The supports are hollow which fluidly communicate with each other and the conduit for filling the bags. The framework formed by the conduit and supports allows the bags to be assembled, filled and accurately positioned as a unit and is sacrificial in that it is left in place on the slope with the grout-filled armor bags.

BRIEF DESCRIPTION OF THE DRAWINGS

The actual construction, operation, and apparent advantages of the present invention will be better understood by referring to the drawings in which like numerals identify like parts and in which.

BEST MODE FOR CARRYING OUT THE INVENTION

Figure 1:
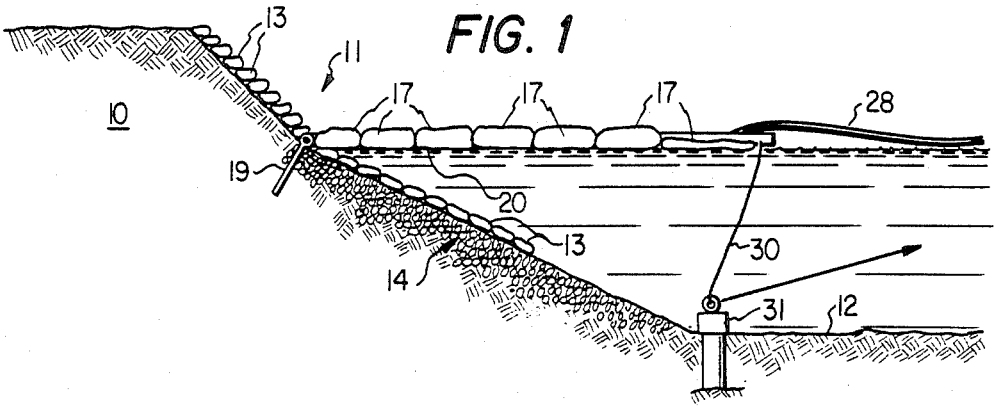
FIG. 1 is an elevational view, partly in section, of the erosion control system of the present invention.
Figure 2:
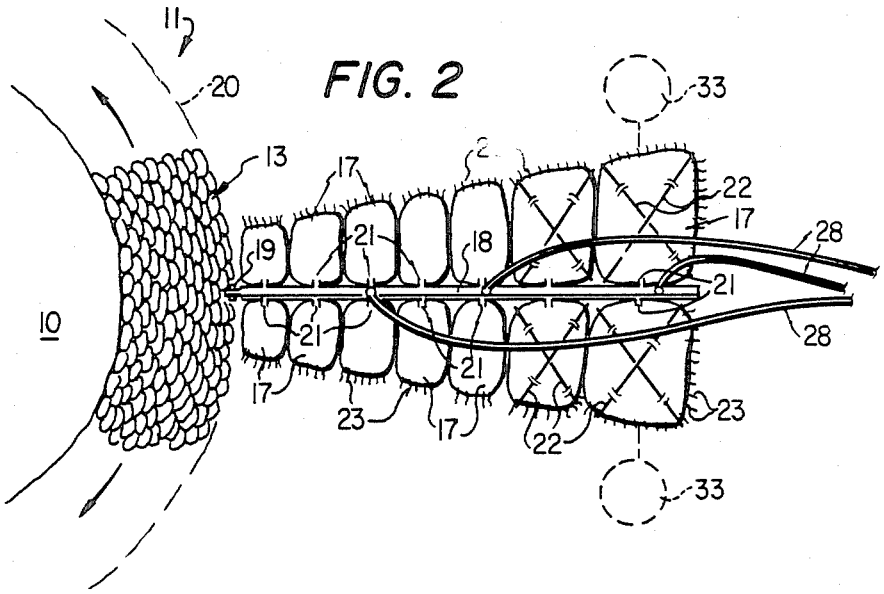
FIG. 2 is a top view of FIG. 1.

Referring now in the drawing, FIGS. 1 and 2 disclose the shoreline 11 of an artificial island 10. It should be understood that while the present invention will be described in relation to an artificial island, it can also be used to protect naturally-occurring shorelines from erosion, without departing from the present invention. Artificial island 10 is one which is formed by dumping "fill" material, e.g. gravel or the like, onto marine bottom 12. The fill material can be barged to site or it can be dredged from the bottom as known in the art.

Island 10, as illustrated, is one which was originally built as a drilling island and has an original shoreline erosion control system installed, e.g. sandbags 13, and gravel dikes and/or additional sandbags 14. For a more complete discussion of artificial islands having this type of erosion control, see (1) "Constructing Artificial Islands in Canada's Beaufort Sea", Ocean Industry, June, 1982, pp 28–31; (2) "New Concepts in Erosion Control", Ocean Industry, July, 1982, pp 88–89; and (3) "Artificial Islands", supra.

As discussed above, the sandbag system 13 and 14 provides good erosion control for the relative short time that island 10 is used for drilling operations. However, if and when island 10 is to be used for an extended period, e.g., as a production island, sandbags 13 and 14 will likely be inadequate to continue to provide the necessary erosion control.

In accordance with the present invention, island 10 is converted from an original drilling island into a production island, when and if the need arises, by accurately positioning additional armor bags 17 onto the slope of the shoreline 11 over any previously positioned bags 13 and 14 thereon.

In accordance with the present invention, a framework of empty armor bags 17 is assembled as shown in FIG. 2. The framework is comprised of a elongated manifold conduit 18, e.g., steel pipe, which is pivoted at its inner end to pin pile 19, concrete "deadman", or the like which, in turn, is driven into slope at the waterline 20 to thereby secure the framework in position. A plurality of armor bags 17 are attached to conduit 18 and each has at least one inlet 21 in fluid communication with the interior of conduit 18. Each bag 17 can be attached to conduit 18 by straps or the like (not shown in FIG. 2) or each can be supported in a frame secured to conduit 18 as will be explained below. Bags 17 are preferably formed of a durable fabric, e.g., nylon or equivalent, and are sized according to the environmental engineering requirements for a particular application. While bags 17 near the base of the slope of shoreline 11 need not be as massive as those near the waterline 20, they will need to cover large areas. Accordingly, bags 17 preferably have a mattress-type configuration as shown in FIG. 2. In some instances, the larger area bags 17 are internally reinforced and/or have rigid cross-members 22 attached externally to keep the bags in an expanded position prior to and during the filling operation. Further, erosion control fibers 23 (i.e. ICI Fibres, Linear Composites Limited, Yorkshire, England) may be sewed or otherwise fabricated around the perimeter of bags 17 to reduce erosional scour between individual bags and/or the framework.

With bags 17 assembled as shown in FIG. 2, grout lines 28 from a work boat (not shown) are connected to conduit 18. In some instances, the framework of bags 17 will be buoyant wherein ballasting is controlled by pumping a grout material to fill the smaller bags 17 first and then progressing outwardly to fill the larger bags to thereby control the sinking of the entire framework as a unit onto slope 13. It can be seen, the grout material (e.g. concrete, sand-cement mixture, and/or sand) will flow from grout lines 28, through conduit 18, through inlets 21, and into bags 17 to thereby fill same. The accurate placement of framework of bags 17 onto the slope of shoreline 11 can be assured by cable 30 which is attached at one end of the framework and runs through an eyelet on a concrete "deadman" anchor or pin pile 31, which is positioned on marine bottom. The other end of cable 30 is connected to a winch or the like on a supply boat (not shown) to accurately place the framework on slope 13. In some instances, the eyelet on pile 31 can be eliminated depending on the environmental conditions during installation. The framework and filled bags are lowered onto the slope by controlled ballasting with line 30 going directly to a crane or winch on a work boat which is payed out as the framework is lowered.

If the framework does not have sufficiently original buoyancy to float same during the original positioning and filling operations, temporary buoyant tanks 33 or the like are attached to the framework which can be released as desired to control the sinking of the framework. Also, conduit 18 may be articulated or segmented (not shown) for use where slope 13 has an irregular contour.

Figure 3:
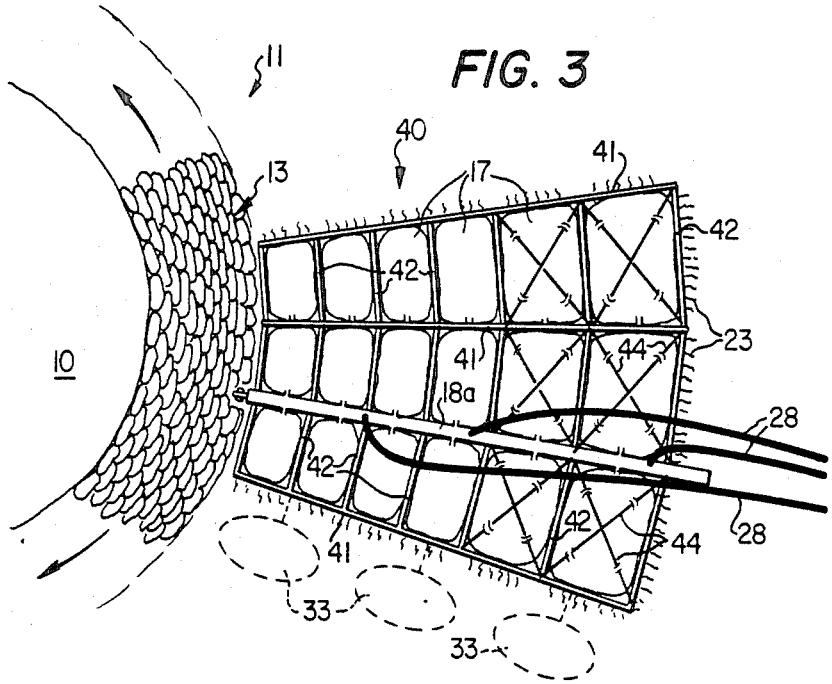
FIG. 3 is a top view of a further embodiment of the present invention.
Figure 4:
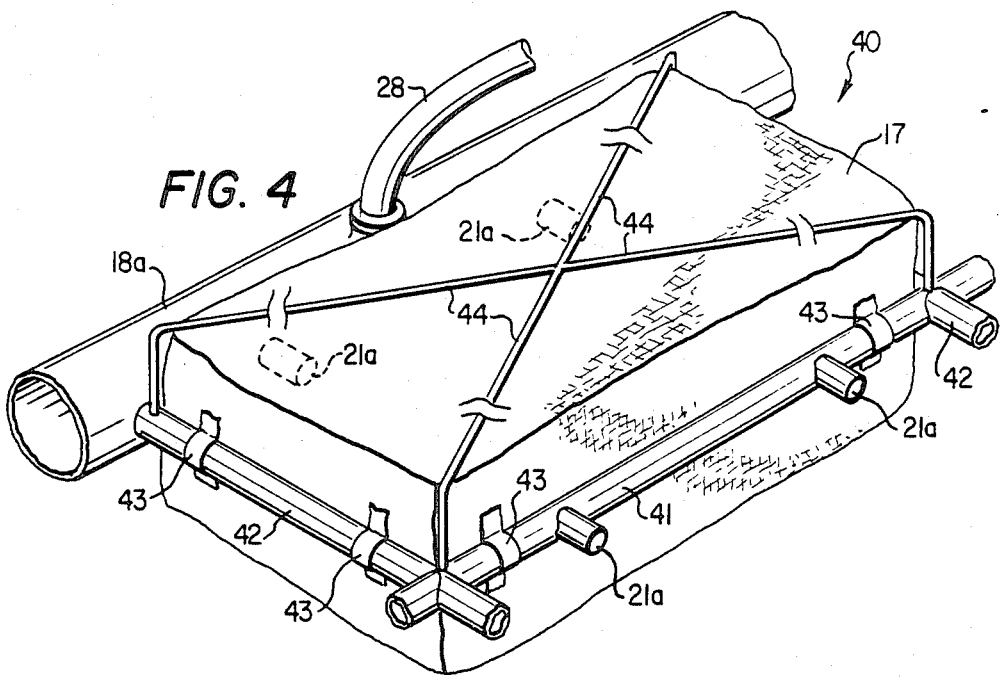
FIG. 4 is an enlarged perspective view, partly in section, of the framework of the system of FIG. 3.

FIGS. 3 and 4 disclose another embodiment of the present invention wherein the framework is a rigid network of support members which form individual support frames for the individual bags 17. Framework 40 is formed of longitudinal manifold **18*a* having grout lines 28 attached thereto. A plurality (three shown) of elongated supports 41 are radially spaced from conduit 18 and are all connected together by respective cross section 42. It can be seen from FIG. 4, that respective supports 41 and 42 form a plurality of individual frames to which respective individual bags 17 can be attached by sewn straps 43 or the like. External diagonal braces 44 are provided, if necessary, to strengthen framework 40**.

Elongated supports 41 and cross supports 42 are rigid conduits which fluidly communicate with each other whereby grout from conduit **18*a* can flow there through to fill all of the bags 17 by means of respective inlets 21*a*. It can be seen that framework 40 can be enlarged by adding additional elongated supports 41 and cross supports 42 to form additional frames for supporting more bags 17**.

By assembling a plurality of armor bags 17, filling them as unit, and positively positioning the unit accurately on slope 13, the reliability of the erosion control system is greatly increased over the difficult and sometimes "hap-hazard" placement of individual armor bags below the waterline.

What is claimed is:

1. A system for controlling erosion of the slope below the waterline of a shoreline, said system comprising:

an elongated conduit;

means to pivotably secure said conduit to said shoreline approximately at said waterline;

a plurality of individual armor bags attached to said conduit; and means for filling all of said individual armor bags with a grout material whereby said armor bags when filled with said grout material will be positioned as a unit onto said slope below said waterline.

2. The system of claim 1 wherein said means for filling said armor bags comprises:

grout lines connected to said conduit; and inlet means for fluidly communicating said conduit to each of said individual armor bags.

* * * * *